US010004977B2

(12) United States Patent
Mollice

(10) Patent No.: US 10,004,977 B2
(45) Date of Patent: Jun. 26, 2018

(54) FOOSBALL TABLE SAFETY ACCESSORY

(71) Applicant: Spirit Mollice, Arlington, TX (US)

(72) Inventor: Spirit Mollice, Arlington, TX (US)

( * ) Notice: Subject to any disclaimer, the term of this patent is extended or adjusted under 35 U.S.C. 154(b) by 0 days. days.

(21) Appl. No.: 15/198,652

(22) Filed: Jun. 30, 2016

(65) Prior Publication Data

US 2017/0001093 A1 Jan. 5, 2017

Related U.S. Application Data

(60) Provisional application No. 62/188,136, filed on Jul. 2, 2015.

(51) Int. Cl.

| | |
|---|---|
| ***A63B 67/14*** | (2006.01) |
| ***A63F 7/07*** | (2006.01) |
| ***A63F 7/06*** | (2006.01) |

(52) U.S. Cl.

CPC ..... *A63F 7/0672* (2013.01)

(58) Field of Classification Search

CPC ..... A63F 7/06; A63F 7/00
USPC ..... 273/108.52
See application file for complete search history.

(56) References Cited

U.S. PATENT DOCUMENTS

| | | | | |
|---|---|---|---|---|
| 2,507,258 A | | 5/1950 | Kohler | |
| 4,078,797 A | * | 3/1978 | Bergee | A63F 7/0672 273/108.52 |
| 4,382,598 A | * | 5/1983 | McCloud | A63F 7/0672 273/108.52 |
| 4,444,393 A | | 4/1984 | Brankovie | |
| 5,112,047 A | | 5/1992 | Monneret | |
| 5,464,220 A | | 11/1995 | Hansen et al. | |
| 5,648,329 A | | 7/1997 | Blake et al. | |
| 5,851,673 A | | 12/1998 | Chen et al. | |

(Continued)

FOREIGN PATENT DOCUMENTS

| | | |
|---|---|---|
| CN | 2477237 | 2/2002 |
| CN | 2668198 | 1/2005 |
| EP | 0473519 A1 | 3/1992 |

*Primary Examiner* — Gene Kim
*Assistant Examiner* — Christopher Glenn
(74) *Attorney, Agent, or Firm* — M. Susan Spiering; Ferrell's PLLC

(57) ABSTRACT

A foosball table safety accessory is disclosed which includes a conical frustum shaped sleeve, a cylindrical nut and a cylindrical sleeve which forms a modified foosball rod bearing nut. The modified foosball rod bearing nut is attachable to and removable from side walls of the foosball table. The cylindrical nut has a through bore with internal threading throughout the length of the through bore. In the conical frustum shaped sleeve, one end is broader than the other side. The cylindrical nut is attached to the broad side of the conical frustum shaped sleeve. The cylindrical sleeve is attached to the narrow side of the conical frustum shaped sleeve. The accessory or protective sleeve would encapsulate the free end of a foosball rod and allows the foosball rod to freely move back and forth, yet provides for the sleeve to be fixed. Overall, a new type of bearing nut together with a polycarbonate tubing or sleeve enhance the safety of the foosball table during use. The accessory would enhance safety by preventing injuries by securing the rod within the sleeve so as the moving rod does not inadvertently hit a bystander. Safety is also enhanced since the rod is not protruding from the sleeve.

10 Claims, 3 Drawing Sheets

(56) References Cited

U.S. PATENT DOCUMENTS

| | | | | |
|---|---|---|---|---|
| 6,027,251 | A * | 2/2000 | Tsai | A63F 7/0672<br>273/108.52 |
| 7,992,872 | B2 | 8/2011 | Simon | |
| 2006/0043667 | A1 | 3/2006 | Schlaefer | |

* cited by examiner

FOOSBALL TABLE SAFETY ACCESSORY

CROSS REFERENCE TO RELATED APPLICATION(S)

This is a non-provisional patent application based on U.S. Provisional Patent Application Ser. No. 62/188,136 previously titled "Foosball Table Safety Accessory", filed on Jul. 2, 2015, the priority of which is hereby claimed and the disclosure of which is incorporated herein by reference in its entirety.

BACKGROUND

Field of the Invention

The present invention relates to accessories for a foosball table. More particularly, the present invention relates to a modified foosball rod bearing nut which enhances safety and prevents injuries to players or children.

Description of the Related Art

Foosball is a German word that means foot plus ball in soccer terms and is played all over the world. Foosball is also widely known as table football, table soccer, baby-foot or kicker in different parts of the world.

Conventionally, a foosball table has a rectangular playing surface surrounded by walls. The foosball table has multiple rods that rotate and slide axially extending across the playing surface. The rods are positioned at an elevated position over the playing surface and are supported in the walls around the playing surface. The foosball table typically has eight rods and openings in the two walls at end of the playing surface. The rods have handles on one side and other side is free. All the handles for each participating team are on the same side of the foosball table. There are four handles on each side, enough for two teams of one or more players to play against each other. Foosball men are mounted to the rods and they move along with the rods. The number of the foosball men on each rod varies based on position of that rod on the foosball table. The walls have bearings which allow the rods to slide smoothly and move back and forth through the bearings. Each player/team uses the handles to move the foosball men to strike a ball into opposing team's goal post.

The first and second rods in the foosball table form a defensive zone in front of the goal. The first rod has a goalie, and the second rod (referred to as "defensive row") has two men. The third rod belongs to the opponent and has its handle mounted on the other side of the table. The third rod (referred to as "striker row") has three men. The fourth rod is the midfield row and has five men. The fifth rod is the opponent's midfield row and has five men. The sixth rod is the striker row. The seventh and eighth rods are the opponent's defensive zone. The players have to periodically switch sides of the table in order to eliminate any advantage that one player may have over the other.

Each rod of the foosball table has a handle on one side and other side is free. The free end of the rod is extended outside of the walls of the foosball table. When the player moves the rod back and forth, there would be cases where the extended portion of the rod might hit the opponent or a person standing near by the foosball table. The children or players near to the foosball table might get hit which would lead to injuries to face, neck and head. Traditionally, the rods of the foosball table are covered with caps in order to reduce the impact. However, these caps reduce the impact but do not ideally prevent the injuries. As a partial solution to the above mentioned drawback, U.S. Pat. No. 5,112,047 discloses a foosball table with wider walls. The free ends of rods are covered in the wider walls so that the foosball table is free of the extended rods outside the walls. A major drawback of this type of foosball table is that the structure is complex and would entail higher costs of manufacturing. Further, such foosball tables occupy more space.

Other than discussed above, no prior art was located pertaining to the relevant feature of the invention. Art directed towards foosball tables found included:

- U.S. Pat. No. 5,112,047 directed towards a table football machine with a protective wall to house the rods.
- U.S. Pat. No. 4,444,393 directed towards a box for party games with bearing tubes for the rods.
- U.S. Pat. No. 2,507,258 directed towards a hockey game table having retractable rods with springs.
- U.S. Pat. No. 6,851,673 directed towards a soccer table with a inner bar slidably nested in the outer bar. The length of the inner bar is shorter than the length of the outer bar.
- U.S. Pat. No. 6,464,220 directed towards a retractable rotating rod for a football table.
- U.S. Pat. No. 6,648,329 directed towards a rotary bar of a soccer table comprising a hollow outer bar in which the inner bar is slidably nested.
- EP 0473519 A1 directed towards a foosball table with protective housing for the bars.
- CN 2477237 Y directed towards a telescopic rotary rod of football table.
- CN 2668198 Y directed towards a recreational table operating-rod bearing device.
- U.S. Pat. No. 7,992,872 B2 directed towards a foosball table.

The above references discuss various methods to enhance the foosball table or provide for telescoping rods which are not considered a part of this invention. The telescoping rods as described in the art do not allow for sufficiently sturdy rods to properly play the game, or enhance safety, are cumbersome and expensive to retrofit onto an existing table.

The Warrier brand foosball table is advertised as an enhanced safety table. However, the rod protectors are not secured and the sleeve slides in to the nut. The rods clip on to the table. Abandoned application US 2006/0043667 A1 describes quick change table rod handles, which also are not sufficiently secured to avoid removal during use.

In light of the foregoing discussion, there exists a need for an accessory that not only enhances safety to the player but also would be easy to install and be of low cost.

SUMMARY

The present invention is directed towards a foosball table, and particularly to the rods that extends out the opposite sides of the table, in particular providing a sleeve for the rod, and a bearing to secure the sleeve. The bearing is designed so as to not interfere with the movement of the rod moving back and forth thru the tubing during game play. Once the sleeve is secured, the rod is held within the sleeve with the tubing protruding or extending beyond the rod.

Hence, an object of the present invention is to provide an accessory for a foosball table to enhance safety. The foosball table accessory includes a conical frustum shaped sleeve, a cylindrical nut and a cylindrical sleeve which forms a modified foosball rod bearing nut (also called the foosball table accessory or accessory). The modified foosball rod bearing nut is attachable to and removable from side walls of the foosball table. The conical frustum shaped sleeve has a through bore and has first and second ends. The first end of the conical frustum shaped sleeve has larger diameter than the second end of the conical frustum shaped sleeve. The cylindrical nut has a through bore with internal threading throughout the length of the through bore. The cylindrical nut has first and second ends where the second end of the cylindrical nut is attached to the first end of the conical frustum shaped sleeve. The cylindrical nut is receivable at bearings in the side walls of the foosball table. The cylindrical sleeve has a through bore and has first and second ends. The first end of the cylindrical sleeve is attached to the second end of the conical frustum shaped sleeve. When the cylindrical nut is received at the bearing of the sidewall of the foosball table, a rod of the foosball table is received inside the cylindrical sleeve through the through bore of the cylindrical nut and the conical frustum shaped sleeve and is movable. The accessory encapsulates the free end of the rod and allows the rod to freely move back and forth inside the cylindrical sleeve. The rod is within the sleeve. The accessory would enhance safety by preventing injuries to children or players standing next to the foosball table by preventing the rod from sticking out of the sleeve and hitting a bystander.

The accessory is easy to install and manufacture. Further, the accessory prevents injuries by improving safety environment to the foosball players. The accessory can be fitted on any standard foosball table without any structural modification provided the table has split bearings, keeping the costs low, and avoiding any major retrofit design. The accessory is convenient to use, easy to install, safety enhancing, and durable for years. While the accessory is described herein in reference to standard United States tables and rods, the accessory is easily modified to any table and rod dimensions. The dimensions herein are for exemplary purposes.

BRIEF DESCRIPTION OF DRAWINGS

The features of the present invention, which are believed to be novel, are set forth with particularity in the appended claims. Embodiments of the present invention will hereinafter be described in conjunction with the appended drawings provided to illustrate and not to limit the scope of the claims, wherein like designations denote like elements, and in which:

DETAILED DESCRIPTION OF EMBODIMENTS

As used in the specification and claims, the singular forms "a", "an" and "the" include plural references unless the context clearly dictates otherwise. For example, the term "an article" may include a plurality of articles unless the context clearly dictates otherwise.

Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present invention.

There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of system components which constitutes an accessory used for achieving enhanced safety conditions to play foosball. Accordingly, the components and the method steps have been represented, showing only specific details that are pertinent for an understanding of the present invention.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Figure 1A:
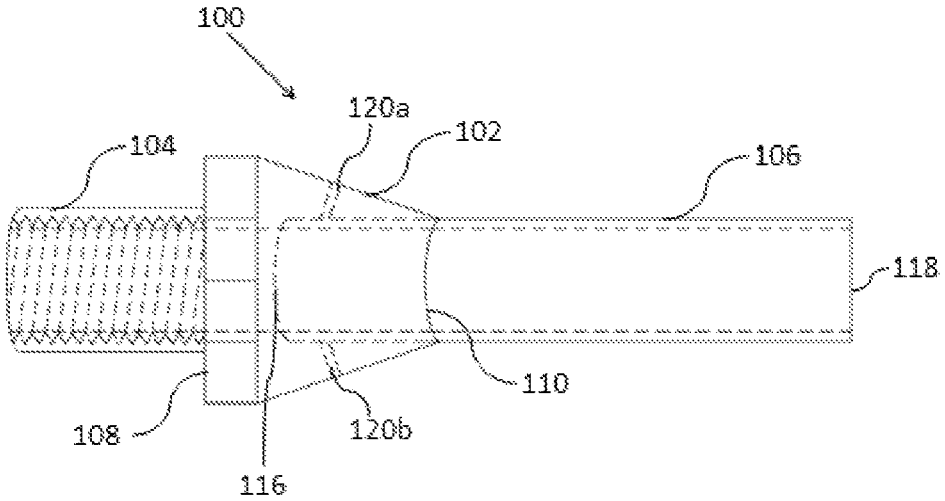
FIG. 1A shows a side view of the accessory for a foosball table.
Figure 1B:
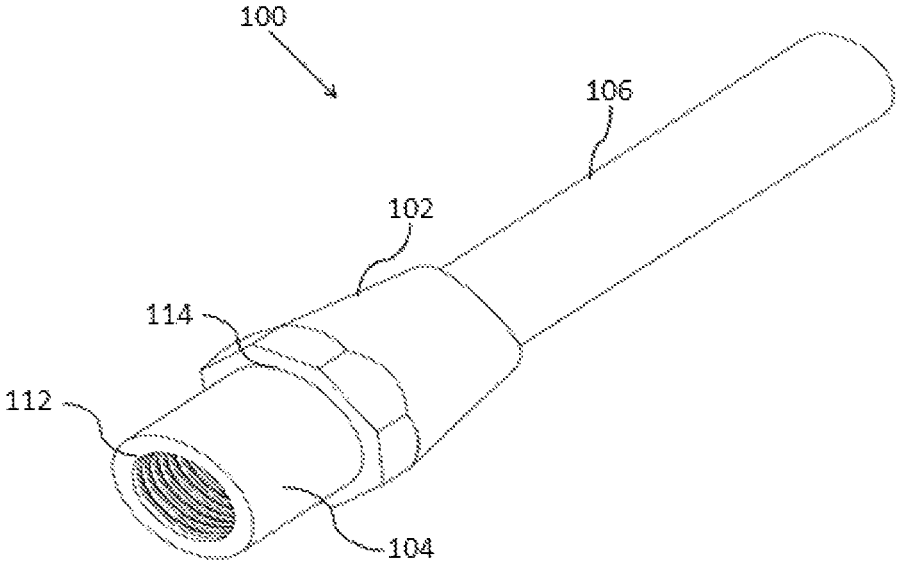
FIG. 1B shows a perspective view of the accessory for the foosball table.

The present invention provides an accessory for a foosball table which enhances the safety of a player. The foosball table safety accessory is also referred to as "Protecto Flex". As illustrated in the FIGS. 1A and 1B, the accessory 100 includes a conical frustum shaped sleeve 102, a cylindrical nut 104 and a cylindrical sleeve 106. The accessory 100 is ideally installed as a foosball rod bearing nut which can replace the traditional nut of the foosball table.

The conical frustum shaped sleeve 102 has a through bore and first and second ends 108 and 110. The first end 108 of the conical frustum shaped sleeve 102 is of octagonal shape. The octagonal shape is shown for illustrative purpose only and any suitable shape may be included without departing from scope and spirit of the present invention. The diameter of the conical frustum shaped sleeve 102 at the first end 108 is more than the diameter of the conical frustum shaped sleeve 102 at the second end 110. In an embodiment, the diameter of the conical frustum shaped sleeve 102 at the first end 108 is 1.5 inches and the diameter of the conical frustum shaped sleeve 102 at the second end 110 is 1 inch. In an embodiment, the conical frustum shaped sleeve 102 is made of a plastic, such as nylon or polyethylene. However, any other suitable material, such as a metal, polyvinyl chloride (PVC) or a resin may also be used. The length and diameter of the sleeve can be altered to fit the size of the rod on the table. One skilled in the art is able to determine the size needed without undue experimentation merely by measuring the width and length of the rod on the table.

The cylindrical nut 104 has a through bore and first and second ends 112 and 114. The second end 114 of the cylindrical nut 104 is attached to the first end 108 of the conical frustum shaped sleeve 102. The attachment of the cylindrical nut 104 to the conical frustum shaped sleeve 102 may be of any suitable process, such as welding. Further, the cylindrical nut 104 and the conical frustum shaped sleeve 102 may be integrally formed, by using a suitable manufacturing process, such as drawing, forging, or casting. The first end 112 of the cylindrical nut 104 is to be inserted in the foosball table. The cylindrical nut 104 has internal threading throughout the length of the through bore. The internal threading of the cylindrical nut 104 is designed to easily engage with the threads of foosball rod bearing bolt of the foosball table. The engagement of the threads leads the first end 108 of the conical frustum shaped sleeve 102 to get attached to the foosball table. The cylindrical nut 104 is made of plastic such as nylon or polyethylene. However, any other suitable material, such as a metal, polyvinyl chloride (PVC) or a resin may also be used.

The cylindrical sleeve 106 has a through bore and first and second ends 116 and 118. The diameter of the cylindrical sleeve 106 is less than the diameter of the through bore of the conical frustum shaped sleeve 102. This allows the first end of the cylindrical sleeve 106 to attach to the second end 110 of the conical frustum shaped sleeve 106. In an embodiment, the cylindrical sleeve 106 is attached to the second end 110 of the conical frustum shaped sleeve 102 through a set of set-screws (not shown). The conical frustum shaped sleeve 106 has a set of slots 120*a* and 120*b* with internal threading at the central portion thereof. The attachment by using set-screws (not shown) through the set of slots 120*a* and 120*b* is shown for illustrative purpose only. Alternatively 3-set screws can be used herein. Any other suitable attachment may be considered without departing from the scope and spirit of the present invention.

In an embodiment, the cylindrical sleeve 106 is made of a polycarbonate material. However, any other suitable material, such as a metal, polyvinyl chloride (PVC) or a resin may also be used. In an embodiment, the inner diameter (ID) of the cylindrical sleeve 106 is ⅞ inches and the outer diameter (OD) of the cylindrical sleeve 106 is 1 inch. Preferably the ID is 1" and the OD is ¾". The length at the sleeve can range from about 3" to about 16" with a preference for about 3.50- to about 14.50 inches, and most preferably about 4 5/16" and 14¼". Generally the ID can range from about ½" to about 1½", and the OD range from ¾" to about 2" provided there is room to fit the sleeve in the table. In an embodiment, the length of cylindrical sleeve is 3.75 inches. In another embodiment, the length of the cylindrical sleeve 106 is 6.25 inches. In yet another embodiment, the length of the cylindrical sleeve 106 is 8.2 inches. In yet another embodiment, the length of the cylindrical sleeve 106 is 13.75 inches. Standard Lengths for current tables which are suitable for the inventive sleeves include: 14¼" 9 1/16", 7¼" and 4 5/16".

Figure 2:
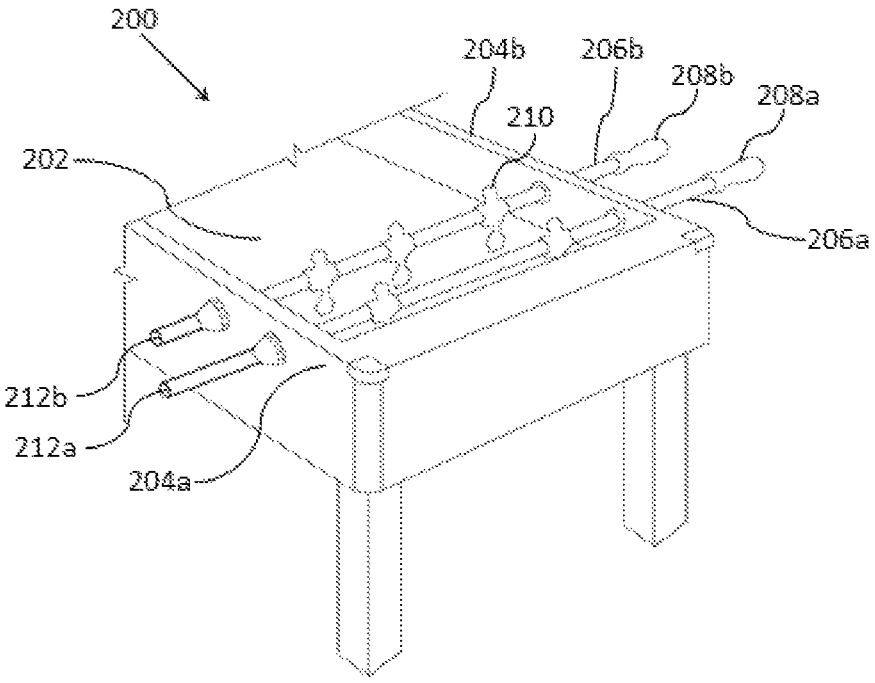
FIG. 2 shows a perspective view of the foosball table with the accessory attached to it.

FIG. 2 illustrates a foosball table 200 with the modified foosball rod bearing nut of the present invention attached to it. The foosball table 200 has a generally rectangular playing surface 202, with first and second side walls 204*a* and 204*b* formed around the playing surface 202. The foosball table 200 has first and second rods 206*a* and 206*b* as shown in FIG. 2. The first and second rods 206*a* and 206*b* are positioned at an elevated position over the playing surface 202 and are supported in the first and second side walls 204*a* and 204*b*. The first and second rods 204*a* and 204*b* rotate and slide axially extending across the playing surface 202. The first and second rods 206*a* and 206*b* have first and second handles 208*a* and 208*b*, respectively on one end. The other ends of the first and second rods 206*a* and 206*b* are free ends. Foosball men 210 are mounted to the first and second rods 206*a* and 206*b*, and move along with the first and second rods 206*a* and 206*b*. The number of foosball men 210 on each of first and second rods 206*a* and 206*b* vary based on the position of the first and second rods 206*a* and 206*b* on the foosball table 200. Each player/team uses the first and second handles 208*a* and 208*b* to move the foosball men 210 to strike a ball into opposing team's goal post.

The first and second rods 206*a* and 206*b* slide freely in the first and second side walls 204*a* and 204*b* with the help of bearings that are fixed inside them. The first side wall 204*a* has a first set of bearings which includes bolts and nuts to allow free movement of the first and second rods 206*a* and 206*b*. The second side wall 204*b* has a second set of bearings which includes a set of bolts and a set of accessories 212*a* and 212*b*. Each of the set of accessories 212*a* and 212*b* includes the cylindrical nut 104 that is screwed to the bolt. The set of accessories 212*a* and 212*b* encapsulate the free ends of the first and second rods 206*a* and 206*b*. The set of accessories 212*a* and 212*b* is installed as bearing nuts for the first and second rods 206*a* and 206*b* on the second side wall 204*b*. The lengths of the cylindrical sleeve 106 of the set of accessories 212*a* and 212*b* depend on the lengths of the first and second rods 206*a* and 206*b* that extend out of the second side wall 204 during the back and forth movement. The desired set of accessories 212*a* and 212*b* is installed on the second side wall 204*b*. The cylindrical sleeve 106 of the set of accessories 212*a* and 212*b* does not interfere with the back and forth movement of the first and second rods 206*a* and 206*b*. The first and second rods 206*a* and 206*b* move inside the cylindrical sleeve 106 by enhancing safety to the people/players near the foosball table 200.

The set of accessories 212*a* and 212*b* is a fixed structure and players are aware of the structure while playing the foosball. Further, the players are aware of the fact that the first and second rods 206*a* and 206*b* move only inside the set of accessories 212*a* and 212*b* as the cylindrical sleeve 106 covers the maximum extendable movement of the first and second rods 206*a* and 206*b*. The cylindrical sleeve 106 of the set of accessories 212*a* and 212*b* would extend outward from second side wall 204*b* of the foosball table 200. The cylindrical sleeve 106 of the set of accessories 212*a* and 212*b* would essentially contain the first and second rods 206*a* and 206*b* as they were pushed across the width of the foosball table 200 and out of the second side wall 204*b*. Thus, the set of accessories 212*a* and 212*b* would provide a protective sleeve that would prevent an individual, specifically a young child, from being struck by the rod when it was forcefully pushed.

The accessory 100 acts as a modified new foosball rod bearing nut for the foosball table. The accessory 100 is easy to install and manufacture. The accessory 100 may be installed in a quick and easy manner likely without special tools and without any modifications to the foosball table. The accessory 100 prevents injuries by improving the safety environment to the foosball players. The accessory 100 would be particularly useful when young or small children are standing next to the foosball table, as it would prevent injuries to the face, head, neck, chest and upper body. The accessory 100 can be fitted on any standard foosball table without any structural modification, keeping the costs low. The accessory 100 is convenient to use, easy to install, safety enhancing, and durable for years. Because the tubing protrudes beyond the inside rod, the chance to be hit or injured by a moving rod is minimized. It has been seen that bystanders to a foosball game in play will be hit by moving rods in the leg or waist area depending on their height. Children depending on their height can be hit in the head or chest area. With the present invention, the tubing is stationary allowing movement of the rod inside. It is known that foosball tables vary in dimensions including the dimensions of the rods, men and kickers. As such, the bearings as described herein can be applied but modified to the size of the rods within the table of choice.

EXAMPLE

The foosball table accessory is installed on a foosball rod bearing on the side of the table opposite the rod handle. For installation, one removes the existing bearing nuts from the rod bearings on a foosball table and replaces them with a set of inventive rod bearing nut which features the polycarbonate tubing. A section of tubing that corresponds to the length of the rod that exited the side of the table opposite its handle is employed. As an embodiment, using a standard US table, the nuts with the sections of tubing measuring 3¾ inches are installed on the bearings that hold the rods five "kickers", while the nuts with the section of tubing measuring 13¾ inches are installed on the bearings that hold the rods with two "kickers".

The tubing on each nut extends outward from the side of the table and contains the rod as it was pushed across the width of the table and out its opposite side. Thus, it provides a protective sleeve to prevent an individual, specifically a young child, from being struck by the rod when it is forcefully pushed.

The accessory provides an inventive bearing nut for foosball tables. Generally, a retrofit for a table would use at least 2 nuts and the respective a polycarbonate tube for encapsulating the rod. The fixed tube would provide a protective sleeve that extends beyond the rod, and since the rod is enclosed or encased within the tube, would prevent an individual from being struck with the rod (an especially dangerous situation if the rod is moving as in during play). While generally all tables can be retrofitted, the invention is especially suited for split bearing systems.

During a game play, this is particularly useful if young or small children are standing next to a foosball table, as it would prevent injuries to the face, head, neck, chest and upper body.

The present invention has been described herein with reference to a particular embodiment for a particular application. Although selected embodiments have been illustrated and described in detail, it may be understood that various substitutions and alterations are possible. Those having ordinary skill in the art and access to the present teachings may recognize additional various substitutions and alterations are also possible without departing from the spirit and scope of the present invention, and as defined by the following claim.

What is claimed is:

1. A foosball table safety accessory secured to a foosball table that includes sidewalls having inner and outer portions, the foosball table safety accessory comprising: a conical frustum shaped sleeve having first and second ends; a cylindrical nut having a through bore, and first and second ends, wherein the second end of the cylindrical nut is attached to the first end of the conical frustum shaped sleeve, and wherein the first end of the cylindrical nut is inserted through the sidewall of the foosball table, and is receivable at a bearing on the outer portion of a sidewall of the foosball table; and a cylindrical sleeve having first and second ends, wherein the first end of the cylindrical sleeve is attached to the second end of the conical frustum shaped sleeve, the first end of the conical frustum shaped sleeve that is attached to the second end of the cylindrical nut abuts the outer portion of the sidewall of the foosball table and the cylindrical sleeve extends away from the foosball table when the cylindrical nut is inserted through the sidewall of the foosball table, wherein a rod of the foosball table is received inside the cylindrical sleeve through the through bore of the cylindrical nut and the conical frustum shaped sleeve, and is movable therein, and wherein the cylindrical sleeve extends beyond the rod to encapsulate an outward extendable movement of the rod across the foosball table.

2. The foosball table safety accessory of claim 1, wherein the cylindrical nut and the conical frustum shaped sleeve are made of at least one of nylon, polyvinyl chloride (PVC), a metal, and a polymer resin.

3. The foosball table safety accessory of claim 1, wherein the cylindrical sleeve is made of at least one of a nylon, polycarbonate, polyvinyl chloride (PVC), a metal, and a polymer resin.

4. The foosball table safety accessory of claim 1, wherein a length of the cylindrical sleeve is in the range of 3" and 16".

5. The foosball table safety accessory of claim 4, wherein the length of the cylindrical sleeve is one of 4⁵⁄₁₆", 7¼", 9¹⁄₁₆", and 14¼".

6. The foosball table safety accessory of claim 5, wherein an inner diameter of the cylindrical sleeve is in the range of ½" to 1½".

7. The foosball table safety accessory of claim 1, wherein the cylindrical nut is made of nylon and has an outer diameter of 1" and an inner diameter of ¾".

8. The foosball table safety accessory of claim 1, wherein the cylindrical sleeve is fixed to the foosball table by securing the cylindrical nut and the cylindrical sleeve.

9. The foosball table safety accessory of claim 1, wherein the foosball table safety accessory is retrofitted to the outer portion of the sidewall of the foosball table.

10. The foosball table safety accessory of claim 1, wherein the cylindrical sleeve is fixed to the foosball table by snapping the cylindrical nut on the outer portion of the sidewall of the foosball table.

* * * * *